United States Patent [19]

Shimozono et al.

[11] Patent Number: 4,918,674

[45] Date of Patent: Apr. 17, 1990

[54] ALARM TIMEPIECE

[75] Inventors: Shigeru Shimozono; Nobuhiro Tanaka, both of Tokyo, Japan

[73] Assignee: Seikosha Co., Ltd., Japan

[21] Appl. No.: 274,734

[22] Filed: Nov. 14, 1988

Related U.S. Application Data

[63] Continuation of Ser. No. 196,836, May 9, 1988, abandoned, which is a continuation of Ser. No. 927,850, Nov. 6, 1986, abandoned.

[30] Foreign Application Priority Data

Nov. 14, 1985 [JP] Japan ..... 60-255714

[51] Int. Cl.[4] ..... G04C 21/16

[52] U.S. Cl. ..... 368/255; 368/88

[58] Field of Search ..... 368/72–74, 368/75, 88, 243, 250, 251, 255, 276

[56] References Cited

U.S. PATENT DOCUMENTS 3,577,876 5/1971 Spadini ..... 368/250

3,788,060 1/1974 Kawamura ..... 368/255

4,197,697 4/1980 Mori et al. ..... 368/250

4,362,400 12/1982 Ihochi et al. ..... 368/255

*Primary Examiner*—Vit W. Miska

*Attorney, Agent, or Firm*—Bruce L. Adams; Van C. Wilks

[57] ABSTRACT

An alarm timepiece the internal movements and electronic components of which can be arranged and accommodated more efficiently in that the alarm diaphragm with a piezo-electric element attached thereto is obliquely mounted within the frame of the timepiece to lean from the bottom of the timepiece frame against a rising part of the side of the frame. This arrangement taken in conjunction with a sound emitting opening situated between the outer circumference of the bottom and the rising part of the frame of the timepiece provide an unobstructed path for the alarm sound while taking advantage of otherwise vacant space within the internal movement and electronic component compartment of the timepiece.

14 Claims, 2 Drawing Sheets

ALARM TIMEPIECE

This is a Rule 62 continuation application of parent application Ser. No. 196,836 filed May 9, 1988, now abandoned which in turn is a Rule 62 continuation application of grandparent application Ser. No. 927,850 filed Nov. 6, 1986, has abandoned.

BACKGROUND OF THE INVENTION (1) Field of the Invention

This invention relates to an electronic buzzer type alarm timepiece.

(2) Background Information

A conventional piezo-electric buzzer has a diaphragm 14 with a piezo-electric element 13 attached thereon. It is fixed onto a frame 16 in parallel to the bottom of the frame as shown in FIG. 3 (FIG. 3 being described hereinafter) to form a sound box having a sound emitting opening 15.

In one example, when a piezo-electric buzzer is put in a small-sized timepiece like a wrist watch, there are difficulties in arranging the buzzer parallel to its frame because of limited space. Even with a small diameter diaphragm, the resultant resonance frequency will be high and sound pressure will be insufficient.

In addition, when a sound emitting opening is provided on the watch frame body, the alarm sound will not be audible. This is because the opening is shut by the arm of the user when he or she wears a wrist watch. When the opening must be relatively provided on the rising part of the frame, the resonance space is large, which is a disadvantage in view of the need to save space within the watch.

The present invention offers a structure to improve space-saving and sound pressure.

SUMMARY OF THE INVENTION

The present invention is directed to a diaphragm which is fixed obliquely within a clock frame so that it leans from the frame bottom against the rising part of the body to form a sound box and a sound emitting opening.

DESCRIPTION OF THE PREFERRED EMBODIMENT

Figure 1:
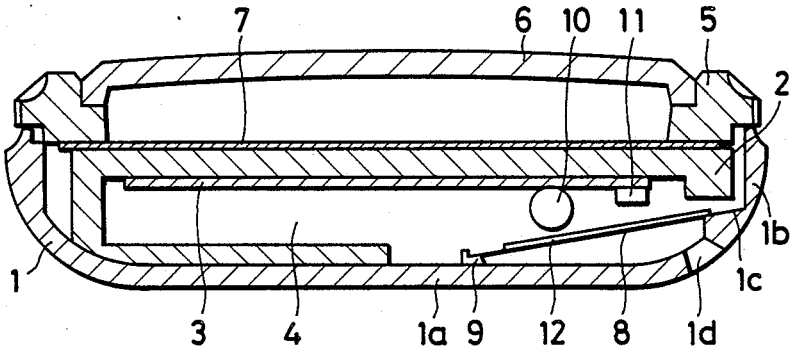
FIG. 1 is a cross-sectional view showing an embodiment of the present invention.
Figure 3:
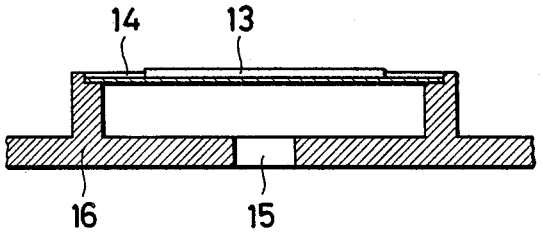
PRIOR ART FIG. 3
FIG. 3 is a cross-sectional view showing an embodiment of a conventional piezo-electrical buzzer.

In FIG. 1, reference numeral 1 is a watch frame in which a collet 2 for timepiece movements (not shown) is arranged. A printed circuit board 3 is secured to the collet 2, and such moving means as a gear train (not shown) and the like are arranged in a compartment 4. Reference numeral 5 is a glass edge secured to the timepiece frame 1. Reference numerals 6 and 7 are a cover and a dial plate respectively.

A projection 9 for fixing a diaphragm 8 is formed inside the frame on its bottom 1*a*, and a shelf 1*c* for the diaphragm 8 is formed inside the rising part 1*b* of the frame 1. The diaphragm 8 is provided with a piezo-electric element 12 and fixed by means of a projection 9 and the shelf 1*c* at an oblique angle with respect to the bottom surface 1*a*. Thus, a desired space saving is obtained by use of the oblique angle thereby enabling the diaphragm 8 to freely clear electronic parts such as a quartz crystal oscillator 10 and an IC (integrated circuit) 11 which are all fixed onto the printed circuit board 3. Furthermore, the use of a relatively large diameter diaphragm 8 allows a significantly large sound pressure.

Figure 2:
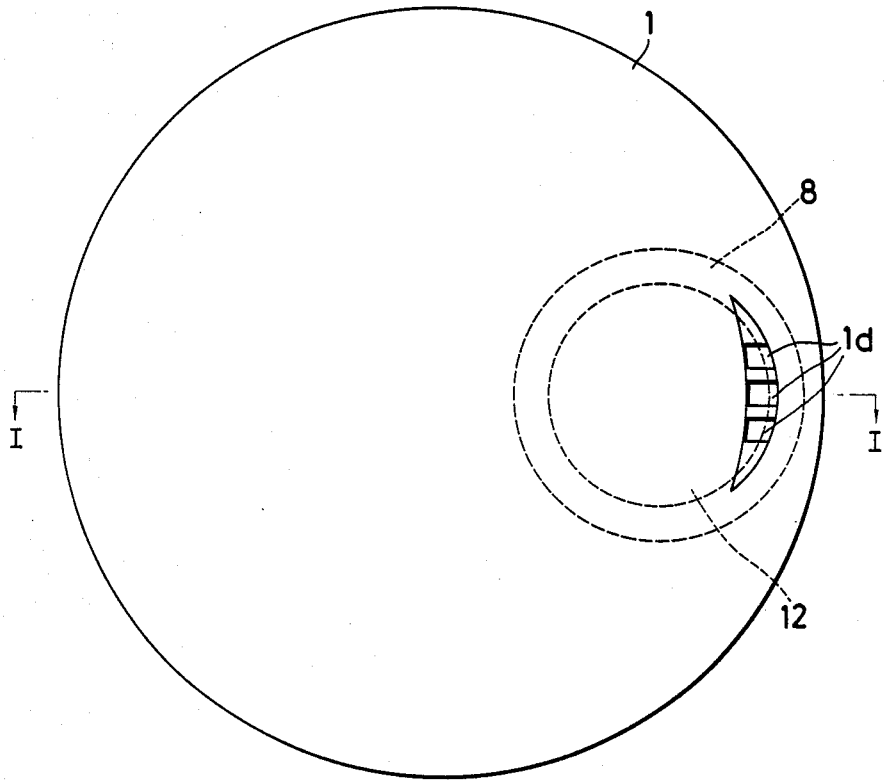
FIG. 2 is a bottom view of the embodiment of FIG. 1.

In addition, a sound emitting opening 1*d* is formed as shown in FIG. 1 and FIG. 2 across the area between the bottom surface 1*a* and the rising part 1*b*. Therefore, the sound emitting opening 1*d*, even when this timepiece device is put around a wearer's wrist, will not be shut by the wearer's wrist and this results in an efficient emission of alarm sounds. In addition, the resonance space capacity formed in the area between the diaphragm 8 and the frame 1 is larger resulting in a decrease in the resonance frequency sufficient to produce a large sound pressure.

Although our description has been made as to the application for a watch, the present invention is not necessarily limited to this application. It is of course applicable in the same manner to small-sized clocks.

In summary, in the timepiece in accordance with the present invention, space-saving is attained. Other parts of the timepiece can be arranged and accommodated more efficiently because the diaphragm is fixed obliquely over the area defined by the bottom and the rising part of the frame. Further, the diaphragm may be made comparatively larger in diameter to produce a relatively large and efficient alarm sound pressure.

In addition, the sound emitting opening is formed at the area defined by the bottom and the rising part of the watch frame and efficient alarm sound emission can be obtained. This is especially true in the case of a watch application where the opening is not shut by a wearer's wrist.

What is claimed is:

1. An alarm timepiece comprising: a frame, a cover, and a rising part of the frame which rises from a bottom of the frame to connect with the cover, a collet mounted within said frame, a printed circuit board secured to said collet, said collet and said frame forming a compartment therebetween for housing timepiece movements and electronic components, a diaphragm having a piezo-electric element attached thereto, said diaphragm mounted directly to said frame and obliquely within said compartment to lean from the bottom of the frame against the rising part of the frame to form a sound box with said frame, said diaphragm forming one wall of said compartment so that vacant space in the compartment becomes resonance space for said diaphragm, and a plurality of circuit components mounted on the printed circuit board and depending therefrom into the compartment, at least one of the circuit components being mounted in the vertical space above the obliquely extending diaphragm.

2. An alarm timepiece according to claim 1; wherein a sound emitting opening is formed in said sound box, said opening being located between an outer circumference of the bottom of the frame and said rising part of the timepiece frame to provide an unobstructed sound path past a wearer's wrist.

3. An alarm timeipece according to claim 1; wherein a plurality of circuit components are mounted in the vertical space above the obliquely extending diaphragm.

4. An alarm timepiece according to claim 1; wherein the at least one circuit component comprises an integrated circuit.

5. An alarm timepiece according to claim 1; wherein the at least one circuit component comprises a quartz crystal oscillator.

6. An alarm timepiece according to claim 1; wherein the diameter of the diaphragm is less than half the diameter of the casing.

7. An alarm timepiece according to claim 1; wherein the diaphragm extends obliquely between a projection on the bottom of the frame and a shelf on the rising part of the frame.

8. An alarm timepiece comprising: a casing having a bottom portion and a sidewall portion; means including a support member mounted within the casing to define therewithin an enclosed compartment bounded by the support member and the bottom and sidewall portions; a printed circuit board attached to the underside of the support member and extending into the compartment; a diaphragm having a piezoelectric element attached thereto for producing an audible alarm sound, the diaphragm being mounted obliquely within the compartment between the bottom and sidewall portions so as to divide the compartment into a resonance space on the outwardly facing side of the diaphragm and an interior space on the inwardly facing side of the diaphragm; and circuit components mounted on the printed circuit board and depending therefrom into the interior space of the compartment, at least one of the circuit components being mounted in the vertical space above the obliquely extending diaphragm thereby reducing vacant space within the compartment.

9. An alarm timepiece according to claim 8; including means defining a sound-emitting opening in the casing sidewall portion communicating the resonance space with the exterior of the timepiece for enabling the audible alarm sound to be transmitted outside the timepiece.

10. An alarm timepiece according to claim 9; wherein the alarm timepiece comprises a wristwatch; and the sound-emitting opening is positioned so as not to be obstructed by the wearer's wrist during use of the wristwatch.

11. An alarm timepiece according to claim 10; wherein the casing sidewall portion has a curved section adjacent to the casing bottom portion, the sound-emitting opening being positioned in the curved section.

12. An alarm timepiece according to claim 8; wherein the casing has an upstanding projection on the bottom portion and a radially extending ledge on the sidewall portion, the diaphragm being mounted on the projection and ledge so as to extend obliquely between the bottom and sidewall portions.

13. An alarm timepiece according to claim 8; wherein the circuit components include a quartz crystal oscillator and an integrated circuit at least one of which is mounted in the vertical space above the obliquely extending diaphragm.

14. An alarm timepiece according to claim 8; wherein the diameter of the diaphragm is less than half the diameter of the casing.

* * * * *